US006572717B1

(12) United States Patent
Louwers et al.

(10) Patent No.: US 6,572,717 B1
(45) Date of Patent: Jun. 3, 2003

(54) HYDRAZINIUM NITROFORMATE

(75) Inventors: Jeroen Louwers, Waalre (NL); Antonius Eduard Dominicus Maria Van Der Heijden, DEN Haag (NL)

(73) Assignee: Nederlandse Organisatie Voor Toegepast-Natuurwetenschappelijk Onderzoek Tno (NL)

( * ) Notice: Subject to any disclaimer, the term of this patent is extended or adjusted under 35 U.S.C. 154(b) by 0 days.

(21) Appl. No.: 09/700,052

(22) PCT Filed: May 11, 1999

(86) PCT No.: PCT/NL99/00289

§ 371 (c)(1), (2), (4) Date: Mar. 16, 2001

(87) PCT Pub. No.: WO99/58498

PCT Pub. Date: Nov. 18, 1999

(30) Foreign Application Priority Data

May 13, 1998 (NL) ..... 1009155

(51) Int. Cl.[7] ..... C06B 47/08; D03D 23/00; C07C 241/00

(52) U.S. Cl. ..... 149/36; 149/109.6; 564/464; 568/924; 568/944

(58) Field of Search ..... 149/36, 109.6; 564/464; 568/924, 944

(56) References Cited

U.S. PATENT DOCUMENTS 3,222,231 A 12/1965 Markels, Jr. et al.
3,297,747 A 1/1967 Thorton
3,378,594 A * 4/1968 Lovett ..... 260/644
3,658,608 A * 4/1972 Low et al. ..... 149/19
3,708,359 A 1/1973 Low et al.
3,862,864 A * 1/1975 Flynn et al. ..... 149/19.8
3,995,559 A * 12/1976 Bice et al. ..... 102/100
5,557,015 A * 9/1996 Zee et al. ..... 564/464

OTHER PUBLICATIONS

XP–002087083, Chemical Abstracts, vol. 128, No. 10, Mar. 9, 1998, Columbus, Ohio, US; abstract No. 117022. Muelenbrugge, Jan, et al., "Crystallization of energetic materials; the effect on stability, sensitivity and processing properties."

XP–002087084, Chemical Abstracts, vol. 123, No. 18, Oct. 30, 1995, Columbus, Ohio, US; abstract No. 232762. Hatano, Hideo, et al., " Properties of HNF (hydrazinium nitroformate)."

* cited by examiner

*Primary Examiner*—Michael J. Carone
*Assistant Examiner*—Aileen B. Felton
(74) *Attorney, Agent, or Firm*—Muserlian, Lucas and Mercanti, LLP

(57) ABSTRACT

The invention relates to crystalline hydrazinium nitroformate having a length to diameter ratio of at most 2.5 and a sensitivity to friction and shock not below 20 N and 2 J, respectively, as well as to a method for the preparation thereof.

13 Claims, No Drawings

HYDRAZINIUM NITROFORMATE

The invention relates to crystalline hydrazinium nitroformate, to a method for the preparation thereof and to the use thereof in solid propellants, for instance for driving rocket engines and the like.

The use of hydrazinium nitroformate in solid propellant is known from various publications. From U.S. Pat. No. 3,708,359, for instance, a solid propellant composition is known based on hydrazinium nitroformate as an oxidizer and a binder on the basis of a saturated polymer hydrocarbon. The hydrazinium nitroformate is present in the composition in crystalline form. The crystals are bonded by means of the polymer hydrocarbon.

In the production of the solid substance used in the propellant as a crystalline substance, not only chemical specifications with respect to purity of the substance but also physical properties, such as particle form, average particle size and particle size distribution, are at least equally important. The fact is that the physical parameters substantially determine the bulk density of the product and the shake density (or tap density) of the product. The latter measure represents the density of the product after shaking or tapping a prescribed number of times. In particular for powdered materials such as hydrazinium nitroformate used as fillers in a polymer matrix for solid propellants this measure is important.

A high tap density means that the open space (porosity) between the particles is small. This open space should be filled with the polymer matrix. This means that the higher the tap density the larger the amount of hydrazinium nitroformate that may be present in the propellant.

For the use of hydrazinium nitroformate in solid propellants it is important that a high load of solid substance (filling degree) is possible. In practice, filling degrees of 80 wt. % or more are normal for solid propellants. Besides, the rheological behavior of the particles in the polymer matrix is important. This polymer matrix consists of a liquid plastic component which is cured after bringing into the final form. Consequently, efforts are directed, on the one hand, to realizing a highest possible filling degree and, on the other hand, to still having a mixture capable of being processed into any desired form (for instance by casting), after which it is cured.

For use in solid propellants hydrazinium nitroformate is often recrystallized after the synthesis to meet the requirements of purity and desired average particle size. In the present production techniques, however, a needle-shaped product is obtained which generally has a length to diameter ratio (L/D value) of at least 4 to 5. It has been found that the crystalline substances having such length to diameter ratios are hard to process into a propellant with a filling degree of at least 80 wt. %.

Another aspect of the use of hydrazinium nitroformate is the sensitivity of the product to shock and/or friction. Hydrazinium nitroformate can be rapidly decomposed by shock and/or friction. It has been found that adaptations during the recrystallization process with the purpose of obtaining a morphology that is more suitable for processing into solid propellants with a high filling degree may give rise to an increased sensitivity to shock and/or friction, which involves more risk during the processing into solid propellants. It is, for instance, known from U.S. Pat. No. 3,222,231 to reduce the length to diameter ratio to 1.5 by recrystallization under ultrasonic treatment. An examination has shown that such a product has a substantially increased sensitivity to shock or friction as compared with the starting product.

It is an object of the invention to provide a crystalline hydrazinium nitroformate with which, on the one hand, a high filling degree can be obtained, while, on the other hand, the processability of the dispersion of the crystals in the liquid polymer matrix prior to curing is good.

The invention is based on the surprising insight that it is possible to obtain crystalline hydrazinium nitroformate having a length to diameter ratio of at most 2.5 and a sensitivity to friction and shock not below 20 N and 2 J, respectively.

According to a preferred embodiment of the invention such a crystalline hydrazinium nitroformate is obtainable by pressing crystals having a length to diameter ratio of at least 3 until a particular pressure, thereby obtaining crystalline material that, after the mechanical treatment, is still free-flowing or can readily be made free-flowing. In this manner, no solid cake of hydrazinium nitroformate is obtained but it appears that a loosely coherent whole is obtained which has substantially retained its original diameter but has a considerably reduced length to diameter ratio.

The mild pressing treatment causes the more or less needle-shaped crystals to break transversely to the longitudinal direction, thereby obtaining the desired length to diameter ratio. It appears that material having the length to diameter ratio according to the invention is readily processable into a solid propellant, while through the treatment the sensitivity to shock and/or friction does not or does not significantly increase.

According to another aspect of the invention two or more fractions of such crystalline hydrazinium nitroformate can be combined with each other to form a composition with a multimodal particle size distribution. Common particle sizes of crystalline hydrazinium nitroformate according to the invention range between 1 and 1,000 $\mu$m. According to the invention a material may then be made which is built up from a multimodal fraction of particles having a (number) average particle size ranging between 1 and 1,000 $\mu$m. It has been found that such combinations lead to considerably higher filling degrees than can be realized with the starting material or with a multimodal mixture of different starting materials.

The invention also relates to a method for the preparation of crystalline hydrazinium nitroformate having a length to diameter ratio of at most 2.5, which comprises pressing a starting material having a length to diameter ratio of at least 3, for instance 4 or more, under a pressure of at most 7 MPa to form a material having the desired length to diameter ratio. According to a preferred embodiment a pressure ranging between 4 and 5.75 MPa is used.

After this treatment the crystals may optionally be subjected to a mechanical post-treatment, for instance to round the sharpest edges of the broken crystals. A suitable treatment is the so-called "drumming", which comprises treating the crystal particles with ceramic balls of about 2 to 3 mm in a slowly rotating cylindrical tube.

The invention will now be explained by means of some examples, which, however, should not be regarded as limitative.

Two fractions of crystalline hydrazinium nitroformate were analyzed. Material A had an average particle size (number) of 575 $\mu$m and an L/D of 5.7. Material B had an average particle size (number) of 100 $\mu$m and an L/D of 5.0. Both materials were pressed at a pressure of about 5 MPa. The tap density and bulk density of the untreated and the treated materials were determined and are given in the following table.

| HNF type | Bulk density [g/cc] | Tap density [g/cc] |
|---|---|---|
| Untreated A | 0.83 | 0.87 |
| Untreated B | 0.51 | 0.65 |
| Treated A | 0.91 | 1.11 |
| Treated B | 0.65 | 0.95 |
| Mixture treated A/B (optimum: 70–65%/ 30–35%) | — | 1.25 |

What is claimed is:

1. A crystalline hydrazinium nitroformate having a length to diameter ratio of at most 2.5 and a sensitivity to friction and shock not below 20 N and 2 J, respectively.

2. A crystalline hydrazinium nitroformate having a length to diameter ratio of at most 2.5, obtainable by pressing hydrazinium nitroformate having a length to diameter ratio of at least 3.

3. A crystalline hydrazinium nitroformate having a length to diameter ratio of at most 2.5, but more than 1.5.

4. A crystalline hydrazinium nitroformate according to claim 1 wherein the average particle size ($d_{50}$) ranges between 1 and 1,000 $\mu$m.

5. A crystalline hydrazinium nitroformate comprising a multimodal particle size distribution.

6. A solid propellant based on hydrazinium nitroformate comprising a matrix material having dispersed therein a crystalline hydrazinium nitroformate according to claim 1.

7. A method for the preparation of crystalline hydrazinium nitroformate according to claim 1 which comprises breaking in a press under pressure needle-shaped crystalline hydrazinium nitroformate having a length to diameter ratio of at least 3.

8. A method according to claim 7 wherein the breaking is effected under a pressure of at most 7 MPa.

9. A method according to claim 8 wherein the breaking is effected under a pressure ranging between 4 and 5.75 MPa.

10. A method according to claim 7 wherein the material is further treated after pressing.

11. A method according to claim 10 wherein the further treatment comprises drumming.

12. The crystalline hydrazinium nitroformate of claim 5, wherein said multimodal particle size distribution is a bimodal particle size distribution.

13. The crystalline hydrazinium nitroformate of claim 5, wherein said multimodal particle size distribution is a trimodal particle size distribution.

* * * * *